United States Patent [19]

Kelley

[11] 4,130,975

[45] Dec. 26, 1978

[54] INSULATION PANEL

[76] Inventor: Jay R. Kelley, 2045 Etowah St., Tarrant, Ala. 35217

[21] Appl. No.: 797,236

[22] Filed: May 16, 1977

[51] Int. Cl.[2] ..... E04C 1/10; E04C 1/30

[52] U.S. Cl. ..... 52/588; 52/406; 52/489; 52/546; 52/593; 52/813

[58] Field of Search ..... 52/588, 489, 593, 144, 52/595, 145, 404, 622, 406, 539, 621, 552, 545, 546, 542

[56] References Cited

U.S. PATENT DOCUMENTS

| | | | |
|---|---|---|---|
| 2,073,036 | 3/1937 | Voigt | 52/588 X |
| 2,358,415 | 9/1944 | Plante | 52/530 X |
| 2,762,470 | 9/1956 | Parkes et al. | 52/404 X |
| 2,989,157 | 6/1961 | Mostoller | 52/404 |
| 3,191,724 | 6/1965 | DeRidder | 52/588 X |
| 3,209,503 | 10/1965 | Mostoller | 52/545 X |
| 3,214,876 | 11/1965 | Mattes | 52/546 X |
| 3,343,321 | 9/1967 | Axelsson | 52/489 X |
| 3,372,520 | 3/1968 | Hensel | 52/404 X |
| 3,420,027 | 1/1969 | Creveling | 52/542 X |
| 3,512,323 | 5/1970 | Hupfer | 52/404 X |
| 3,618,281 | 11/1971 | Hill et al. | 52/404 |
| 3,742,672 | 7/1973 | Schaenfele | 52/595 X |
| 3,813,839 | 6/1974 | Simpson, Jr. et al. | 52/588 |
| 3,961,454 | 6/1976 | Adams | 52/404 X |
| 3,983,674 | 10/1976 | Yamamoto | 52/588 X |
| 4,044,521 | 8/1977 | Fischer et al. | 52/404 |
| 4,063,393 | 12/1977 | Toti | 52/531 X |

FOREIGN PATENT DOCUMENTS

| | | | |
|---|---|---|---|
| 729339 | 3/1966 | Canada | 52/546 |
| 513845 | 9/1952 | France | 52/489 |
| 1506750 | 11/1967 | France | 52/588 |
| 58584 | 11/1967 | German Democratic Rep. | 52/145 |
| 593528 | 5/1959 | Italy | 52/595 |
| 216561 | 10/1967 | Sweden | 52/545 |
| 1384589 | 2/1975 | United Kingdom | 52/546 |

*Primary Examiner*—Leslie Braun

[57] ABSTRACT

An improved insulation panel, which includes first and second extruded elongated aluminum plates, one of which contains a channel and the other a projection, by means of which they are placed in abutting engagement to form a single panel with a tongue formed on the end of one of said plates and a groove on the other of said plates, to permit placing a plurality of panels in abutting relationship without gaps therebetween, and in which, on the outside edges of each of said plates, and thus on the outside edges of said panel, there are formed C shaped channels, one of said channels, having installed therein, a plurality of mounting clips, and the other, having installed therein, a plurality of insulation retaining clips, both of said pluralities of clips being slideable in said channels, to facilitate the installation of said panels, with insulation retained behind the panels, against a structure such as a duct, precipitator or boiler requiring insulation.

13 Claims, 8 Drawing Figures

INSULATION PANEL

BACKGROUND OF THE INVENTION

This invention relates to insulation panels in general, and more particularly, to an improved insulation panel particularly useful for application to boiler walls, precipitator walls, ducts, tanks and other types of equipment requiring insulation.

Due to the energy shortage and high costs of energy, insulation of various types of equipment for purposes of heat conservation is becoming increasingly important. Together with the requirements for greater amounts of insulation, the costs of insulation has also risen. These costs have resulted from a greater demand for insulation caused by the fuel shortage and generally inflated construction costs. Because of this, it is important that any insulation system be capable of installation at low cost, giving good thermal efficiency and having a long service life. Furthermore, it should have a pleasant aesthetic appearance.

Prior art systems do not fulfill all of these requirements. An example of such a prior art system is that disclosed in U.S. Pat. No. 3,961,454. Disclosed is a prefabricated insulation panel which has a face member of imperforate sheet material with a top flange and an upright attaching flange at the rear thereof. It also includes an inside foot flange, spaced above the bottom edge of the face member, defining a lapping bottom portion. Insulation material is received and retained against the inside of the face member between the top flange and the foot flange. This type of construction aids in pointing out the number of disadvantages of prior art systems. When attached to a structure, the attaching flange uses a plurality of appropriate sheet metal screws, or the like, inserted therethrough. In this manner, the whole of the flange comes into contact with the structure being insulated and can result in increased heat loss through conductivity. Furthermore, appropriate holes must be made at proper mounting locations for insertion of the screws. This raises installation costs. Furthermore, because the face member is made of a sheet material, it lacks a certain amount of dimensional stability and tolerances cannot be held. Furthermore, when such panels are subjected to wide temperature changes, problems can result because of thermal expansion. It has been typical in insulating panels, to use such a bent sheet or rolled sheet, to form panels and thus most systems suffer from these disadvantages. The panels of this patent do attain a certain amount of simplicity in construction by the utilization of the foot flange and mounting flange to obtain overlapping. However, at the point of overlap there is a large metal area which permits the transmission of heat by conduction. In addition, mounting is difficult.

There have been some attempts to ease the problems of mounting insulation, and permit better interlocking in associated areas. An example is U.S. Pat. No. 3,618,281 which utilizes interfitting panels having tongue and grooved connections. The disclosed panel is for use in a wall type panel rather than an insulating device. In U.S. Pat. No. 2,989,157 sliding chips are used for mounting the insulation. However, there is a requirement for a die clinching operation. Thus, although it has the ability to move the insulating mounting means, which aids to a great degree in installation, since holes need not be drilled at appropriate locations, which locations may differ from installation to installation, it suffers from other problems, i.e., it requires a die clinch. Furthermore, it utilizes a sheet type material and thus suffers from the above-noted disadvantages. Another type of insulating panel is that shown in U.S. Pat. No. 3,372,520. The described panel is a complete insulated panel in which the insulating material is contained within an outer skin and inner skin. The units fit together in a tongue and groove attachment, with the panels themselves attached to stringers by means of fastening members rotatable on the stringer. The manner in which the fastening members cooperate with the panels permits attaching to the panels at any location along its length. Panels of this nature, are not particularly well adapated for use in the insulation of ducts, boilers, precipitators etc. Furthermore, they do present a large path for heat conduction and also are made using sheet metal materials, which suffer the above-noted disadvantages.

In view of the needs outlined above and the lack of the prior art to fill these needs, the requirement for an improved insulating panel is evident.

SUMMARY OF THE INVENTION

The present invention provides a solution to these problems. This is accomplished by means of a two part insulating panel which comprises a right hand plate and a left hand plate interlocked together. Both plates are made of extruded aluminum. One of the plates contains on its longitudinal edge a tongue, and the other plate, on its longitudinal edge, a matching groove. The right hand and left hand plates are assembled and attached with their mating connection before being supplied to the user. Each of the right hand plates and the left hand plates also contain a projection which contains a channel at their edges. These projections extend inwardly from the face of the plate. The channel on the one edge is adapted for receiving a mounting clip and that on the other end for receiving an insulation retaining clip. Appropriate insulation is retained by the mounting and insulation clips and disposed between the insulation panel and the structure being insulated. Both the insulating clips and mounting clips are capable of sliding motion in their associated channels thereby permitting them to be located at appropriate places where the structure to be insulated is structurally strong. The clips are mounted by using a powder actuated pin which can be shot through the mounting clip and driven into a stiffener flange, or the like, therebehind.

DETAILED DESCRIPTION OF THE INVENTION

Figure 1:
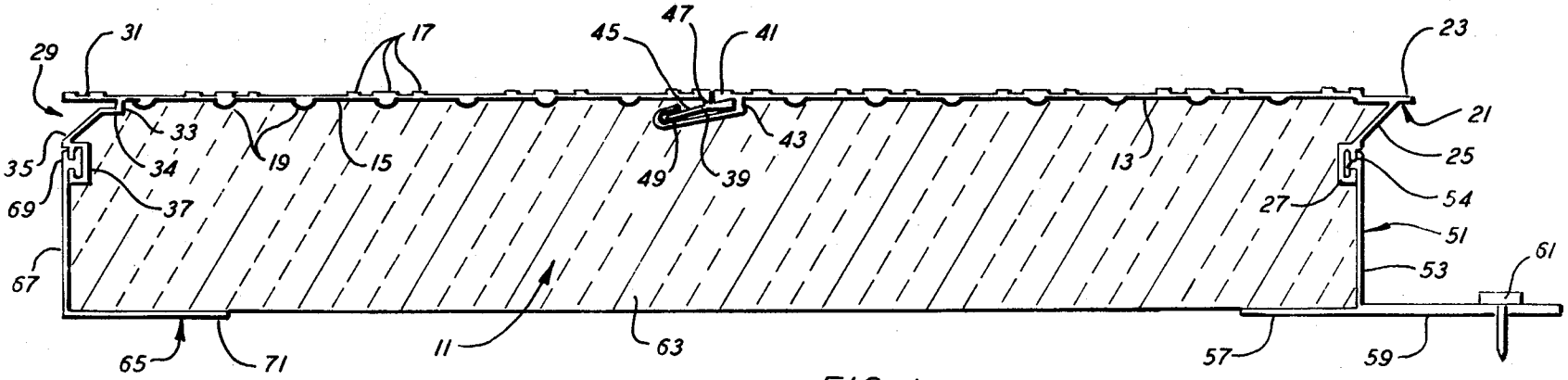
FIG. 1 is a cross-section through a first embodiment of the present invention.
Figure 2:
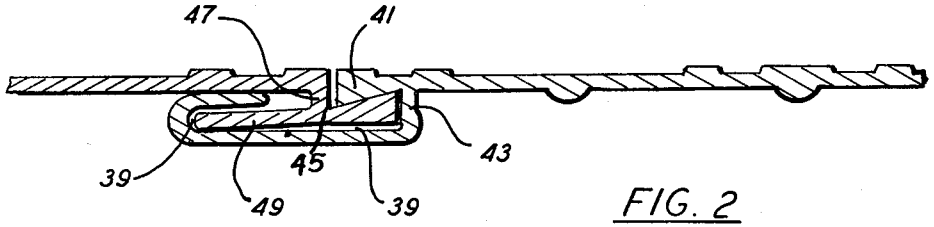
FIG. 2 is a cross-section of a portion of FIG. 1 after the two plates are pressed or rolled together.

FIG. 1 is a cross-section through an insulating panel 11 according to the present invention. As illustrated, the insulating panel 11 is made up of a right hand plate 13 and a left hand plate 15. Each of the plates are of extruded aluminum and contain a plurality of rectangular ribs 17 on their exterior side and a plurality of half round ribs 19 on their interior side. The ribs on the inside and outside are provided for strengthening purposes, with the ribs on the outside also adding to the aesthetic appearance. Each plate is approximately 6" over its useable length to give a panel width of approximately 12". The right hand plate has at its right hand end a tongue connector 21. The tongue connector 21 includes a horizontal portion 23, from approximately the middle of which, an angular portion 25 extends inwardly. At the end of the angular portion there is provided a C shape channel 27. The left hand panel on its left hand end contains a groove 29 which matches the right hand panel. As illustrated, the groove 29 is made up of a horizontally extending portion 31 of the panel itself, a downwardly extending portion 33, a horizontally extending portion 34 connected thereto and an angular portion 35 on the end thereof. Also depending downward from portion 35 is another C shaped channel 37. The right hand plate 13 has at its left hand end an angled recess 39. The part of plate 13 directly above the recess has an angular projection 41. The recess is formed by a member 43 which extends first downward then at an angle to the horizontal and then around a radius so as to be almost parallel to its previous downward direction. The left hand plate 15, on its right hand end, contains a mating portion 45 for insertion into the channel 39. This portion 45 includes a downwardly depending part 47 having on the end thereof an angular part 49, the left hand end of which is adapted to fit in the bent radius part 39 of the member 43, and the right hand end of which is adapted to mate with the angled part 41 of the right hand plate 13. In FIG. 1 the two plates are shown immediately after the left hand plate with its projection member 45 is slid into the angled recess 39 of the right hand plate. Thereafter a pressing or rolling operation is carried out to compress the area where the two plates meet so that the connection is bent flush as is illustrated by FIG. 2.

Figure 3:
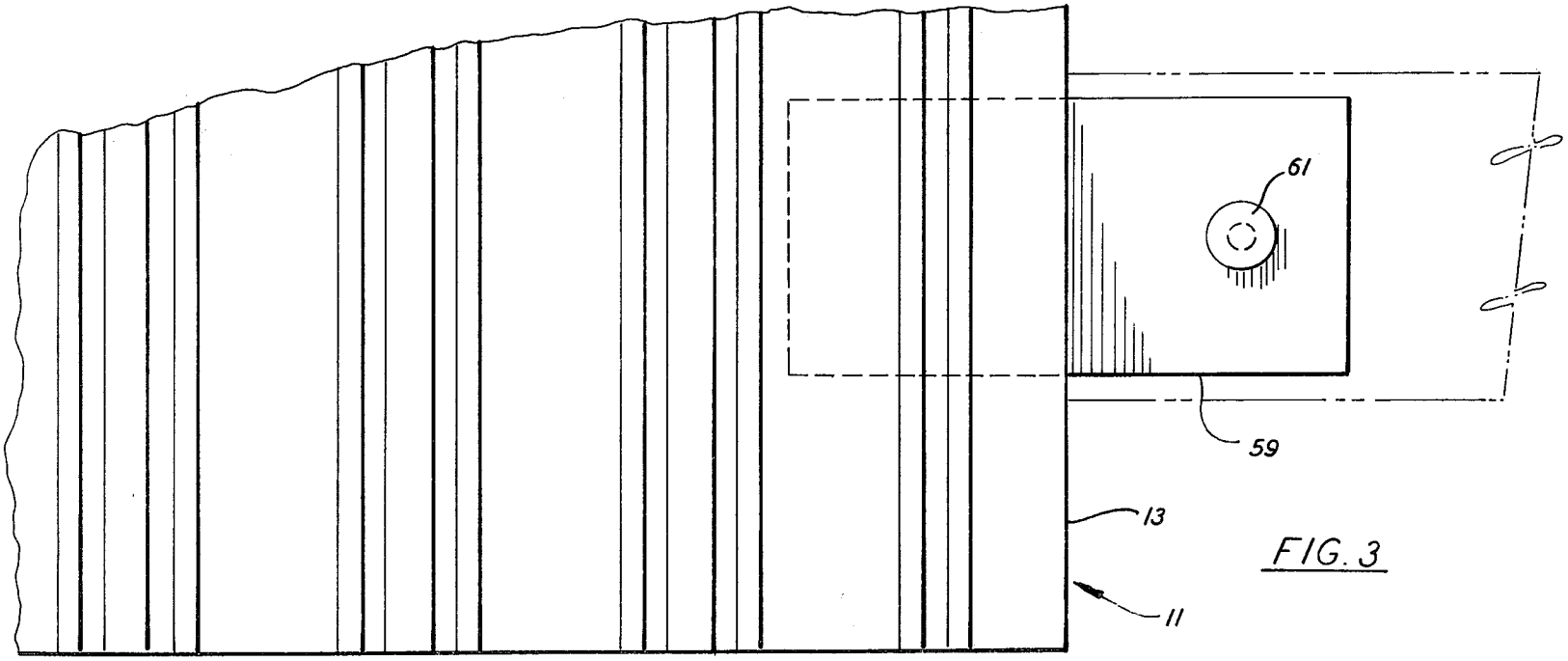
FIG. 3 is a plan view of the embodiment of FIG. 1.

Shown disposed in FIG. 1 in the C shaped channel 27 of the right hand plate is an insulation mounting clip 51. The mounting clip 51 includes a vertical member 53 containing on its end a mating projection 54 which mates with the C channel 27. At the bottom of the vertical portion 53 are outwardly extending horizontal portions 57 and 59. As is more clearly shown on FIG. 3 a powder actuated pin 61 is driven through the extending portion 59 for mounting to the stiffener flange of a duct or the like. This mounting pin 61 can be screwed, bolted, welded or propelled by gun powder or the like through mounting clip 51 into the stiffener flange of the duct. The extending portion 57 has as its purpose retaining insulation 63 which will be disposed behind the panel 11. On the other end of panel 11, an L shaped retaining clip 65 is provided, having a vertical portion 67 with a projection 69 on the end thereof for engaging in the C shaped channel 37 and a horizontal portion 71 for retaining the insulation 63. Both the insulation clips 65 and the mounting clips 51 are capable of sliding motion in their appropriate channel. A plurality of each are provided with each panel for purposes of mounting the panel to an appropriate structure and retaining the insulation in place.

In operation, a panel having a plurality of mounting clips and insulation retaining clips thereon, the panel comprising a right hand plate and left hand plate which have been fastened together, is placed against the structure to be insulated. Typically a panel will be 12" wide, but can be made in any width desired, either by mounting several panels together or by extruding them to the desired width. A typical length for insulating ducts or the like is 10'. After being placed against the structure, the mounting clips are aligned with appropriate stiffening flanges in the duct or other structure and powder actuated pins (or other mounting means) shot therethrough to hold the panel in place. Thereafter, the next panel is placed in abutting relation, with its groove on the left hand plate, for example, engaging the tongue on the right hand plate of the first panel. Installation continues in this manner along each straight portion of the structure, thereby enclosing the entire structure in a blanket of insulation.

Figure 4:
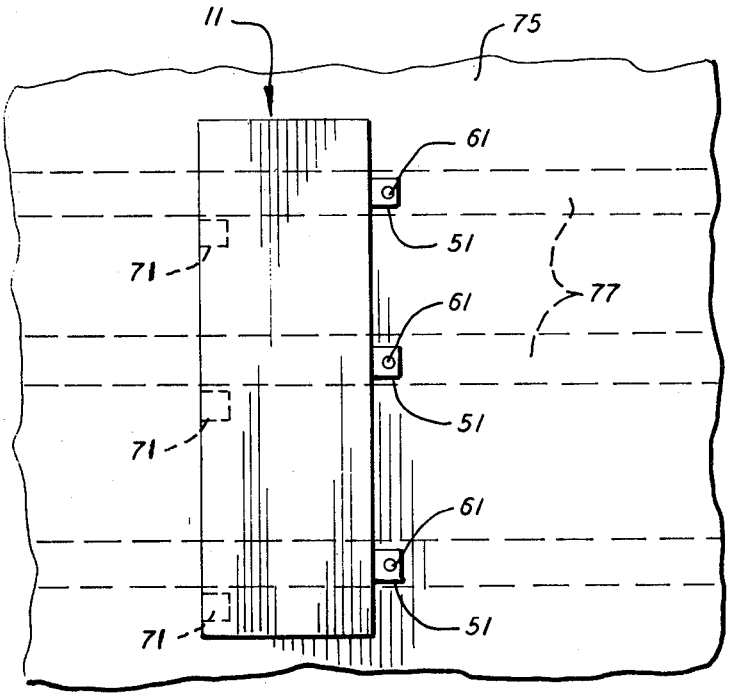
FIGS. 4 and 5 show the panels of FIGS. 1 and 3 at different stages of installation.

FIG. 4 shows a panel 11 mounted to a structure 75 such as the side of a boiler. The panel is put at the desired location, the mounting clips 51 positioned to line up with structural members 77 and powder actuated pins 61 shot through the mounting clips 51 and into the structural members 77.

Figure 5:
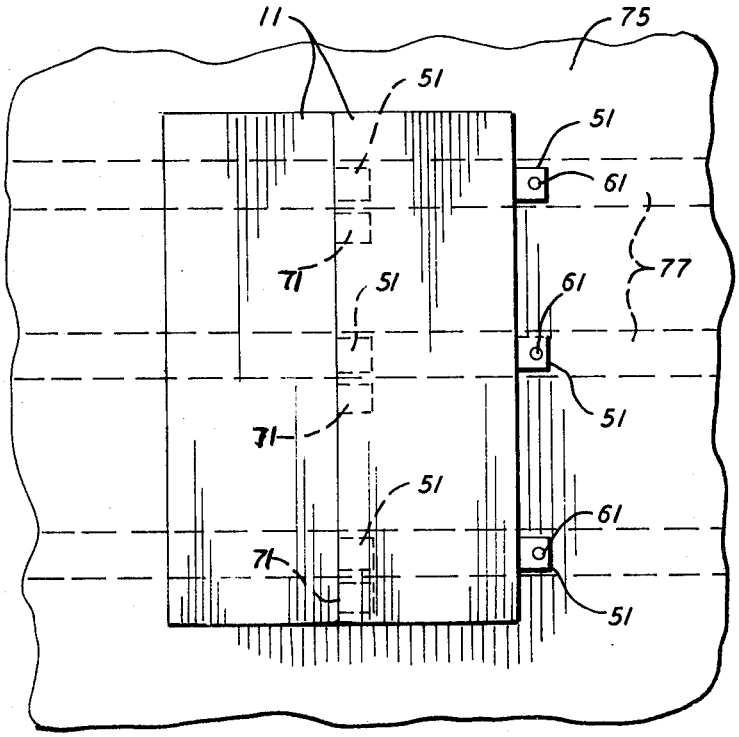

FIG. 5 shows the manner in which the second panel is put into place. The insulation retaining clips 65 and the insulation retaining projection 71 are offset with respect to the horizontally extending portion 59 of the insulation mounting clips at the point where the two panels 11 fit together with the tongue and groove arrangement described above. Once again the mounting clips 51 are attached to the structural members 77.

Figure 6:
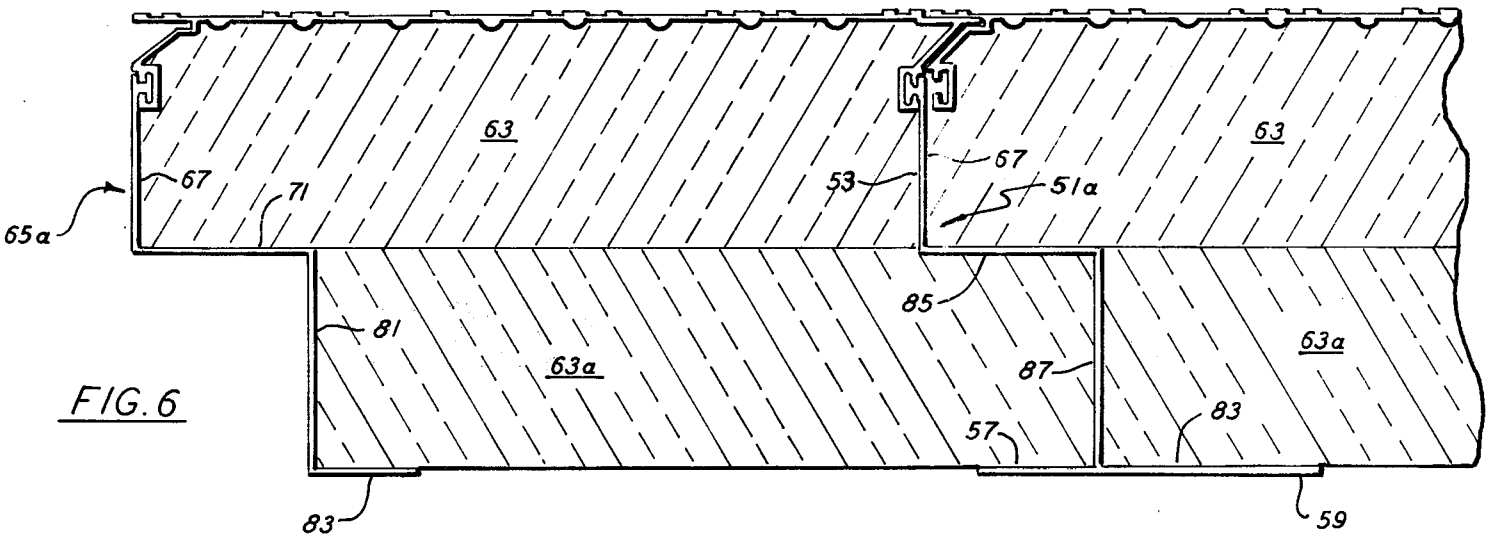
FIG. 6 is a cross-sectional view of a further embodiment of the present invention.

A further embodiment which permits the construction of a "ship lap joint" for double layers of insulation, is illustrated by FIG. 6. The only difference is in the insulation retaining clips and mounting clips. Each of these have the same basic construction as before, except that they contain a horizontal offset. Thus, the insulation retaining clip **65*a* shown in FIG. 6 has a vertical portion 67 as before and a horizontal portion 71. However, it has an additional vertical portion 81 and horizontal portion 83. Similarly, the insulation mounting clip 51*a* has a vertical portion 53 but then has a horizontal portion 85, another vertical portion 87 and then the two horizontal extending portions 57 and 59 as the previous embodiment. The result is that there are two overlapping areas for retaining insulation. Thus, the insulation 63 is retained by the horizontal portion 71 and a second layer of insulation 63*a* is retained by the horizontal portions 83 (on the insulation clip 65*a*) and 57 on the mounting clip 51*a***. This Figure also shows the mating of two panels.

Figure 8:
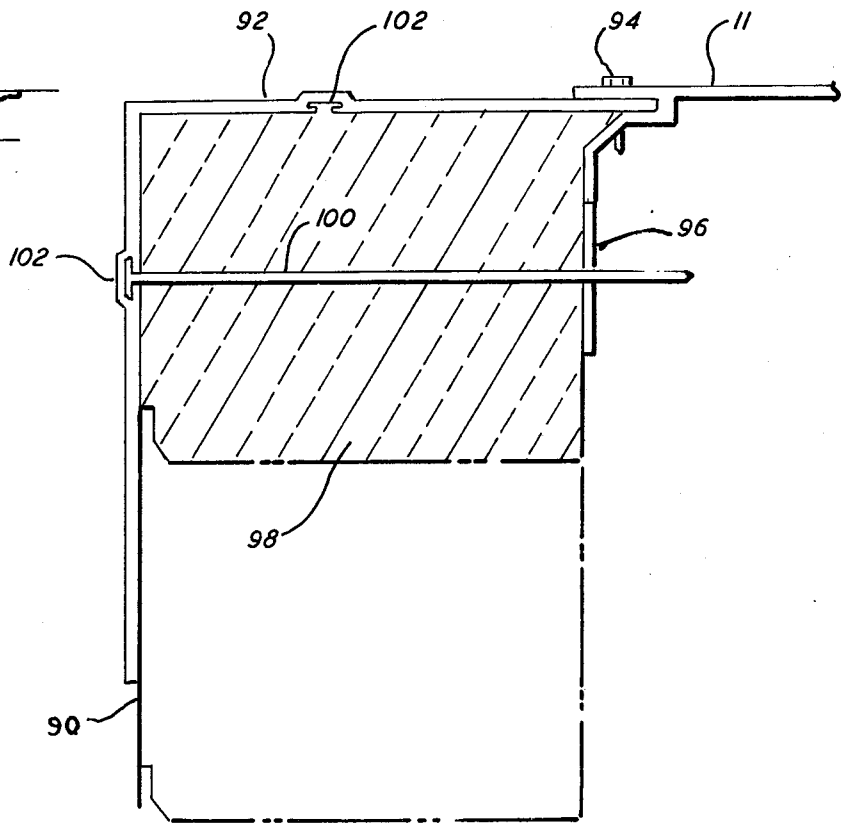
FIG. 8 is an expanded view of the corner portion enclosed within the dotted line in FIG. 7.
Figure 7:
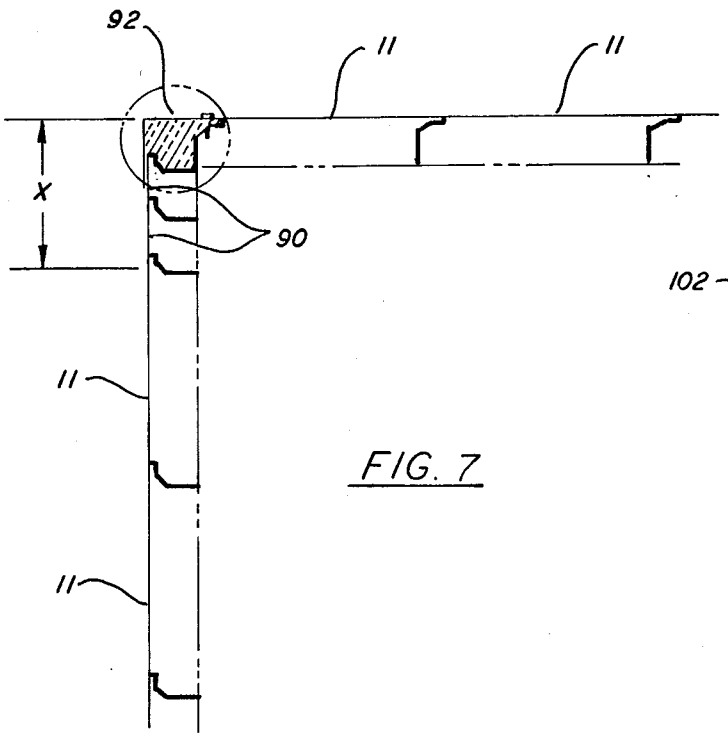
FIG. 7 is a cross-section of a right-angled corner installation of the present invention.

In some installations it is necessary to mount the embodiment shown in FIGS. 1–5 around right angle corners. One system for accomplishing this is shown in FIGS. 7–8 in which FIG. 7 shows a typical corner installation with FIG. 8 showing in greater detail the installation of a corner finishing flange shown within the dotted circle of FIG. 7.

As set forth earlier in this application, standard insulation panels 11 are nominally 12" in width. Thus, as shown in FIG. 7, a series of insulation panels 11 are progressively mounted to the sides of the structure. Frequently, however, because the distance "X" between the last panel and the edge of the corner is less than 12", some provision must be made to cover the distance without cutting a 12" panel or manufacturing a custom-sized panel. In order to accomplish this, a plurality of fill-in panels 90, shown in FIG. 7, are made. Typically, these panels 90 may be formed in two widths, 4" and 6". Thus, "X," the distance between the last panel and the edge of the corner (see FIG. 7) may be bridged by an individual panel or a combination of panels 90, combined according to the following table:

| "X"Dimension Greater Than | Not More Than | Use | Leaving |
|---|---|---|---|
| 10" | 12" | a 4" and a 6" panel | 1–2" |
| 8" | 10" | two 4" panels | 1–2" |
| 6" | 8" | a 6" panel | 1–2" |
| 4" | 6" | a 4" panel | 1–2" |
| 0 | 4" | — | 4" |

Both the 6" and the 4" panels 90 are identical to the panels 11 and are formed to mate with the standard 12" plates 11 formed of right hand plate 13 and left hand plate 15, except panels 90 are formed of a unitary structure without the interior angled recess 39, angular projection 41, member 43, mating portion 45, downwardly depending part 47, and angular part 49. The plates 90, however, are formed with identical tongue connectors 21 and groove 29 which is constructed and operates in the same manner as described earlier in this specification.

Thus, the 4" and 6" panels 90 may be connected singularly, or in combination, to bridge a distance "X" between the last panel and the edge of a corner. By forming the panels with identical connectors 21 and grooves 29, insulation mounting clips 51 and L shaped retaining clips 65 may be used with the fill-in plates 90.

At the corner itself, a corner insulation fill cover 92 is used when needed to complete the corner. As shown in FIG. 8, cover 92 is formed of a right angle member nominally 4" to 6" wide on each side. Thus, as shown in FIG. 8, it may overlap panel or plates 90 on one side and, after cutting to size, interconnect with the first panel 11 on the other side, where it is fastened to panel 11 by self tapping screw 94.

To install the fill cover 92 a standard speed clip 96 is first mounted to the underlying support. Insulation 98 is then installed at the corner with a fastener such as nail 100 mounted through speed clip 96. As shown in FIG. 8, corner insulation fill cover 92 may have extruded retainer slots 102 formed within the fill cover itself. Thus, to properly mount the corner fill cover 92, the head of fastener 100 is slipped into retainer slots 102. In this manner insulation is efficiently and neatly installed at a corner location on an object.

The construction of the present invention offers numerous advantages over the prior art. Because an extrusion process is utilized, a panel which offers excellent dimensional stability to within several one thousandths of an inch is obtained. Such tolerances are far superior to any that were obtained in the prior art which utilizes sheet bending and/or roll formed panels. Heat efficiency is increased. Because of the tolerances noted above, it is possible to get a superior butt joint or a ship lap joint, and elimination of heat leaks, which are prevelant in most existing panel systems, is achieved. In addition, the conductivity through metal is reduced to an absolute minimum by a design of the mounting clips and insulation retaining clips with minimized metal to metal contact.

The panels also have a pleasing aesthetic appearance and can be provided with a variety of painted finishes as well as plain anodized aluminum. The extruded plates have a raised rib exterior pattern which lends to the overall appearance in addition to increasing structural strength of the installed panel.

As is evident from the discussion above, the panel errection process is greatly simplified since the mounting clips can be easily adjusted to accommodate various stiffener spacings. This greatly reduces errection costs.

Because each panel is independently supported, the interlocking tongue and groove design in the panels of the present invention is ideal for accommodating thermal expansion. Finally, studies have shown that all of these advantages can be achieved at a cost which is below that of most panel systems presently on the market. It should be noted that the primary reason for using the right hand and left hand plate construction, with the two plates joined to form a panel, is to reduce extruding costs and permit a lighter gauge of metal to be extruded. By using these two interlocking plates to form a panel, it thus becomes possible to minimize extrusion costs while still having all the advantages of an extruded aluminum plate.

In this specification and the claims, directions such as outward, downward, etc., unless otherwise indicated refer to the panel as shown on FIG. 1. It will be recognized that the panel can be installed in any orientation and that these terms are simply used to aid in a clear definition of the relationship between various elements.

What is claimed is:

1. An insulation panel comprising:

(a) a first elongated extruded aluminum plate of a first width;

(b) a second extruded aluminum plate of equal length and second width;

(c) a channel formed at one longitudinal end of one of said plates, said channel being formed by a member extending from said panel and having a short portion extending inwardly essentially perpendicular to said panel at a distance from said one longitudinal end thereof, a portion extending from said perpendicular portion essentially parallel to the plane of said panel beyond said one longitudinal end thereof, the end of said portion bent in a radius to form a partially closed channel; and (d) a matching projection at one longitudinal end of the other of said plates, said projection including a portion projecting inwardly essentially perpendicular to said other plate disposed at the longitudinal end of said plate and a second portion extending in both directions from said perpendicular portion essentially parallel to said plate so that when assembled said matching projection fills said channel and permits said channel to be pressed tightly about said projection, such that said plates are in abutting relationship over their length to thereby form a panel.

2. The panel according to claim 1 and further including a plurality of raised ribs on the side of said panel which will be exposed when installed, said ribs extending in the longitudinal direction of said panel and parallel to the longitudinal edges thereof.

3. The panel according to claim 1 and further including a tongue at the other longitudinal edge of one of said plates, and a matching groove at the other longitudinal edge of the other of said plates whereby a plurality of said panels may be mated together with said tongues and grooves when installed.

4. The panel according to claim 3 and further including (a) a downwardly dependent flange containing a channel at each of the other longitudinal ends of each of said plates;

(b) a plurality of mounting clips for use in mounting said panel to a structure each including at least one vertical portion having on one end thereof a projection matching the channels in said flanges and slidably disposed in one of said channels and at least one horizontal portion extending outward from the other end of said mounting clips; and (c) a plurality of insulation retaining clips for retaining insulation behind said panel, including at least a vertical portion having on one end thereof a projection matching the channels in said flanges, slidably inserted in the other of said channels, said insulation retaining clips also having a horizontal portion, extending inwardly from the other end of said retaining clip.

5. The panel according to claim 4 wherein said mounting clips have a first outwardly extending horizontal portion for mounting purposes and a second inwardly extending horizontal portion for retaining insulation and wherein said insulation retaining clips are L shaped.

6. The panel according to claim 4 wherein said mounting clips have a first vertical portion having said matching projection on the end thereof, a first horizontal portion extending therefrom in an outward direction; a second vertical portion extending downward from said first horizontal portion and at least a second horizontal portion extending outward from said second vertical portion for use in mounting; and wherein said insulation retaining clips include a first vertical portion having said projection on the end thereof, a first horizontal portion extending inwardly therefrom; a second vertical portion extending downward from said first horizontal portion and a second horizontal portion extending inwardly therefrom whereby a double layer of insulation may be retained and whereby said panels with insulation therebehind may be placed in abutting relationship in a ship lap joint type configuration.

7. The panel according to claim 6 and further including an inwardly extending third horizontal portion at the end of said second vertical portion of said mounting clips.

8. The panel according to claim 6 wherein said first and second widths are equal.

9. An insulation system comprising:

(a) an insulating panel including:

(1) a first elongated extruded aluminum plate of a first width;

(2) a second extruded aluminum plate of equal length and second width;

(3) a downwardly depending channel formed at one longitudinal end of one of said plates and a matching projection at one longitudinal end of the other of said plates inserted in and fixedly retained by said channel such that said plates are in abutting relationship over their length so as to thereby form a panel;

(4) a tongue at the other longitudinal end of one of said plates;

(5) a matching groove at the other longitudinal end of the other of said plates whereby a plurality of said panels may be mated together with said tongues and groove when installed; and (6) an inwardly depending flange containing a channel extending from the tongue and the groove at the other longitudinal ends of each of said plates;

(b) plurality of mounting clips each including at least one vertical portion having on the end thereof a projection matching the channels in said flanges and at least one horizontal portion extending in a direction outward from said other longitudinal end slidably disposed in one of said channels for use in mounting said panel to a structure; and (c) a plurality of insulation retaining clips each including at least a vertical portion having on the end thereof a projection matching the channel in said flanges slidably inserted in the other of said channels, said insulation retaining clips also having a horizontal portion, extending inwardly with respect to the longitudinal edge, for retaining insulation behind said panel.

10. The system according to claim 9 and further including a plurality of raised ribs on the side of said panel which will be exposed when installed, said ribs extending in the longitudinal direction of said panel and parallel to the longitudinal edges thereof.

11. The system according to claim 9 wherein said mounting clips are T shaped having a first outwardly extending horizontal portion for mounting purposes and a second inwardly extending horizontal portion for retaining insulation and wherein said insulation retaining clips are L shaped.

12. The system according to claim 9 wherein said mounting clips have a first vertical portion having said projection on the end thereof, a first horizontal portion extending therefrom in an outward direction; a second vertical portion extending downward from said first horizontal portion and at least a second horizontal portion extending outward from said second vertical portion for use in mounting and wherein said insulation retaining clips include a first vertical portion having said projection extending inwardly therefrom; a second vertical portion extending downwardly from said first horizontal portion and a second horizontal portion extending inwardly therefrom whereby a double layer of insulation may be retained and whereby said panels with insulation therebehind may be placed in abutting relationship in a ship lag type configuration.

13. The system according to claim 12 and further including an inwardly extending third horizontal portion at the end of said second vertical portion of said mounting clips.

* * * * *

UNITED STATES PATENT AND TRADEMARK OFFICE

CERTIFICATE OF CORRECTION

PATENT NO. : 4,130,975

DATED : December 26, 1978

INVENTOR(S) : Jay R. Kelley

It is certified that error appears in the above-identified patent and that said Letters Patent are hereby corrected as shown below:

Column 1, line 62, change "chips" to --clips--;

Column 8, line 54, change "lag" to --lap--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*